US005752568A

United States Patent [19]

Lee

[11] Patent Number: 5,752,568

[45] Date of Patent: May 19, 1998

[54] REFRIGERATOR HAVING A COMPARTMENT FOR FERMENTING FOOD AND A FOOD CONTAINER FOR USE THEREWITH

[75] Inventor: Jang Hee Lee, Seoul, Rep. of Korea

[73] Assignee: Samsung Electronics Co., Ltd., Suwon, Rep. of Korea

[21] Appl. No.: 325,028

[22] Filed: Oct. 18, 1994

[30] Foreign Application Priority Data

Jul. 18, 1993 [KR] Rep. of Korea ..... 1994-17306
Oct. 22, 1993 [KR] Rep. of Korea ..... 1993-22017

[51] Int. Cl.[6] ..... F25B 29/00

[52] U.S. Cl. ..... 165/206; 165/263; 165/64; 219/530; 219/531; 439/138

[58] Field of Search ..... 165/30, 64, 206, 165/263; 219/530, 531; 439/138

[56] References Cited

U.S. PATENT DOCUMENTS

| | | | |
|---|---|---|---|
| 797,215 | 8/1905 | Osborne et al. | 439/138 |
| 1,060,011 | 4/1913 | Newton | 439/138 |
| 1,552,813 | 9/1925 | Amman | 219/530 |
| 1,649,506 | 11/1927 | Brewer | 219/530 |
| 2,253,971 | 8/1941 | Dodge | 165/64 |
| 2,311,446 | 2/1943 | Knight | 165/30 |
| 2,375,714 | 5/1945 | Wild | 165/30 |
| 2,681,972 | 6/1954 | Holland | 219/531 |
| 3,505,499 | 4/1970 | Walter | 219/530 |
| 3,736,981 | 6/1973 | Shevlin | 165/30 |
| 5,228,499 | 7/1993 | Yoon | 165/30 |
| 5,398,599 | 3/1995 | Woo | 165/30 |
| 5,408,071 | 4/1995 | Ragland et al. | 219/530 |

FOREIGN PATENT DOCUMENTS

| | | | |
|---|---|---|---|
| 0232792 | 8/1987 | European Pat. Off. | 439/138 |
| 0161683 | 6/1989 | Japan | 439/138 |

OTHER PUBLICATIONS

Exploded View and Wiring Diagram of Prior Art Refrigerator with Kimchi Heater, (No Date).

*Primary Examiner*—John K. Ford
*Attorney, Agent, or Firm*—Burns,Doane, Swecker & Mathis, L.L.P.

[57] ABSTRACT

A refrigerator has a compartment for fermenting foods such as kimchi. The food is disposed within a container that is slidable into the compartment. The container includes an electrical connector projecting from a container wall and which becomes plugged into a recessed electrical connector disposed in a wall of the compartment in response to insertion of the container into the compartment. The container carries a heater and a temperature sensor which are electrically connectable, via the electrical connectors, to a controller disposed in the refrigerator housing.

14 Claims, 8 Drawing Sheets

FIG. 4(A)
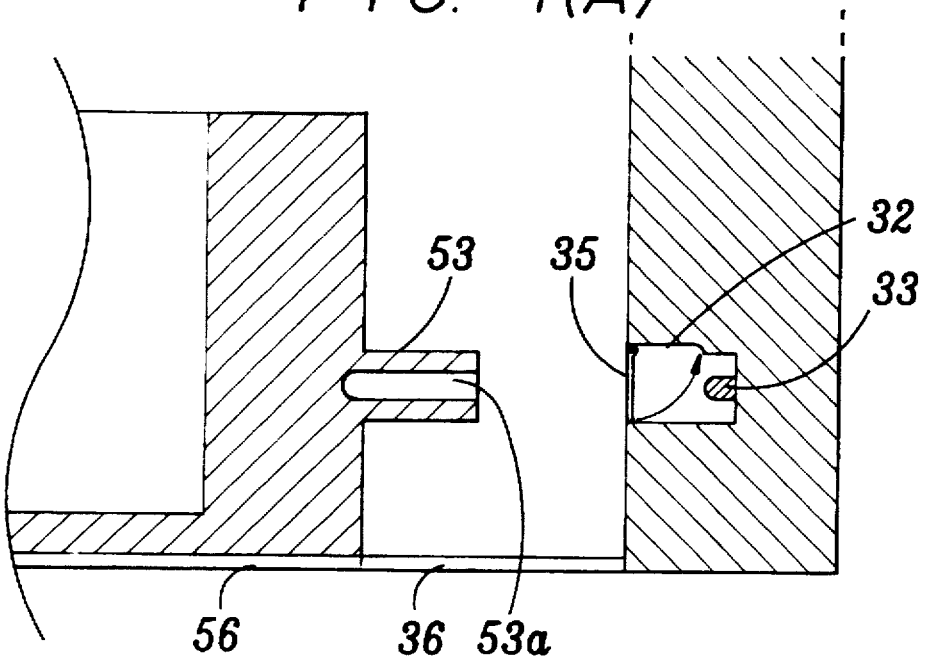
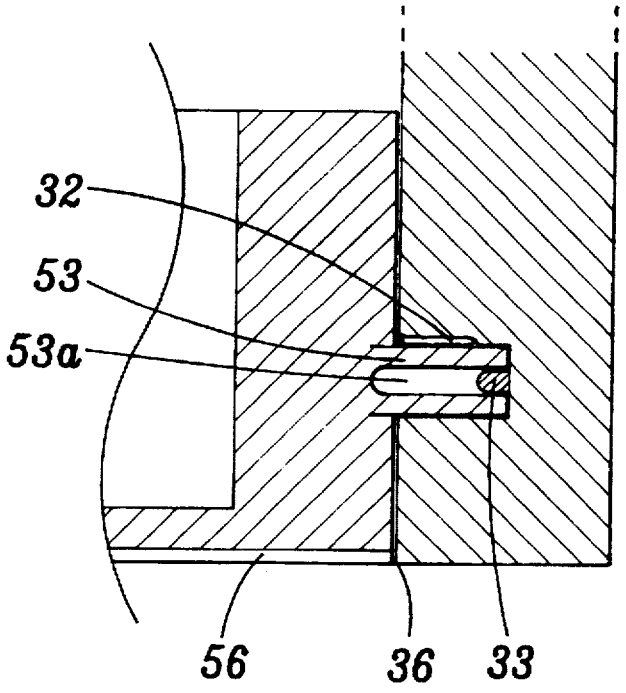
FIG. 4(B)

(B)

REFRIGERATOR HAVING A COMPARTMENT FOR FERMENTING FOOD AND A FOOD CONTAINER FOR USE THEREWITH

BACKGROUND OF THE INVENTION

1. Field of the Invention

The present invention is related to a refrigerator with a function of fermenting food.

2. Description of the Prior Art

Recently, diverse improvements have been made in a refrigerator which can ferment food, for example Kimchi. (As is well known, Kimchi is a traditional Korean naturally fermented food which is made of radish, cabbage or cucumber, spiced with pepper, garlic, onion, ginger, and so on. The Kimchi fermentation process chiefly relies on temperature and time. Hereinafter, the description will proceed, taking Kimchi as an example of fermentation food.). The fermented food is then stored in the refrigerator at a lower temperature, for example, a temperature within a range of 3° C. to 5° C. A good example of such a refrigerator (for convenience sake, called a Kimchi refrigerator in the following description) is disclosed in U.S. Pat. No. 5,228,499.

The refrigerator disclosed in that patent includes a compartment (hereinafter, called a fermentation/storage compartment) for providing either a fermentation environment or a storage environment, a container (hereinafter, called a fermentation container) for containing Kimchi to be fermented, and a heater for raising the temperature of the fermentation/storage compartment to a temperature required for fermenting food.

In the conventional Kimchi refrigerator, when the fermentation function is selected, the fermentation/storage compartment is maintained at a required fermentation temperature for a required time by intermittently activating the heater, thereby causing Kimchi to be optimally fermented. After the fermentation work is completed, the fermentation/storage compartment is automatically maintained at a required storage temperature lower than the fermentation temperature in order to prevent further acidification of the Kimchi. This work is performed by supplying cool air to the fermentation/storage compartment simultaneously with the deactivation of the heater.

By the way, in the conventional Kimchi refrigerators, the heater has been disposed (1) on the wall of the fermentation/storage compartment, (2) at the inside of the wall of the fermentation/storage compartment, or (3) in the space of the fermentation/storage compartment. In the above-described third embodiment, an additional blower fan has been generally provided behind the heater.

The Kimchi refrigerator according to the above-described first embodiment has a problem in that the available space of the fermentation/storage compartment is reduced due to a thick heat insulator for preventing heat radiated from the heater from being transmitted to the neighboring compartment, and in that the heat is unevenly distributed to the whole surface of the fermentation container, thereby causing the Kimchi to be fermented unevenly in different parts.

The Kimchi refrigerator according to the foregoing described second embodiment has a problem in that it is impossible to repair it when the heater is cut off, in addition to the problem attendant upon the foregoing described first embodiment.

The Kimchi refrigerator according to the foregoing described third embodiment may alleviate the problem of uneven fermentation of Kimchi, but still has a problem in that the available space of the fermentation/storage compartment is much reduced because of the installation of the heater and blower fan.

SUMMARY OF THE INVENTION

It is an object of the present invention to provide a refrigerator with a function of fermenting food, and for expanding available space of a fermentation/storage compartment by disposing a heater in the inside of the wall of a fermentation container.

It is another object of the present invention to provide a refrigerator with a function of fermenting food, for minimizing the increase of the temperature in another compartment adjacent to a fermentation/storage compartment by disposing a heater in the inside of the wall of a fermentation container.

It is still another object of the present invention to provide an easily repairable refrigerator with a function of fermenting food.

To solve these objects, the novel refrigerator with a function of fermenting food comprises a fermentation container for containing food to be fermented; a fermentation/storage compartment for receiving the fermentation container; a heater for heating the fermentation container, the heater disposed in the inside of the wall of the fermentation container; a first connecting member provided in the fermentation container, the connecting member electrically coupled to the heater; and a second connected member provided in the wall of the fermentation/storage compartment, the second connected member electrically coupled to a power supply and being connectable to the first connecting member.

In the configuration described above, when a temperature sensing means is further provided within a wall of the fermentation container, and when additional connecting members for respectively transmitting and receiving the temperature signal sensed by the temperature sensing means are respectively provided on the fermentation container and fermentation/storage compartment, more accurate temperature control may be achieved in a fermentation mode.

Furthermore, when a hollow space is further provided within a wall of the fermentation container, even the fermentation of Kimchi may be achieved because the heat radiated from the heater is evenly transmitted to the inner panel of the wall of the fermentation container.

Preferably, the afore-mentioned temperature sensing means may be provided in the hollow space.

The first connecting member may be projected from the surface of the side wall or bottom wall of the fermentation container, and the second connecting member may be disposed within a recess formed in the side wall or bottom wall of a fermentation/storage compartment in relation to the location of the first connecting member.

Preferably, a cover may be provided at the opening of the recess, thereby preventing a short circuit or current leakage due to the humidity in the fermentation/storage compartment.

In case the first and second connecting members are disposed on respective side walls of the fermentation container and fermentation/storage compartment, the connection operation between the connecting members may be easily executed by further providing a pair of legs in the bottom wall of the fermentation container and by further providing a pair of grooves for guiding the legs in the bottom wall of the fermentation/storage compartment.

Furthermore, the first connecting member may be retracted into the wall of the fermentation container, thereby enhancing the maintenance or external appearance of the fermentation container.

BRIEF DESCRIPTION OF THE DRAWINGS

These and other aspects of the present invention are clarified in the accompanying drawings in which:

FIGS. 4(A) and (B) are views for illustrating connecting members, respectively, before and after connection according to the first preferred embodiment of the present invention;

DETAILED DESCRIPTION OF THE PREFERRED EMBODIMENTS

For a better understanding of the present invention, together with other objects, advantages and capabilities thereof, reference is made to the following disclosure and appended claims in connection with the above-described drawings.

Figure 1:
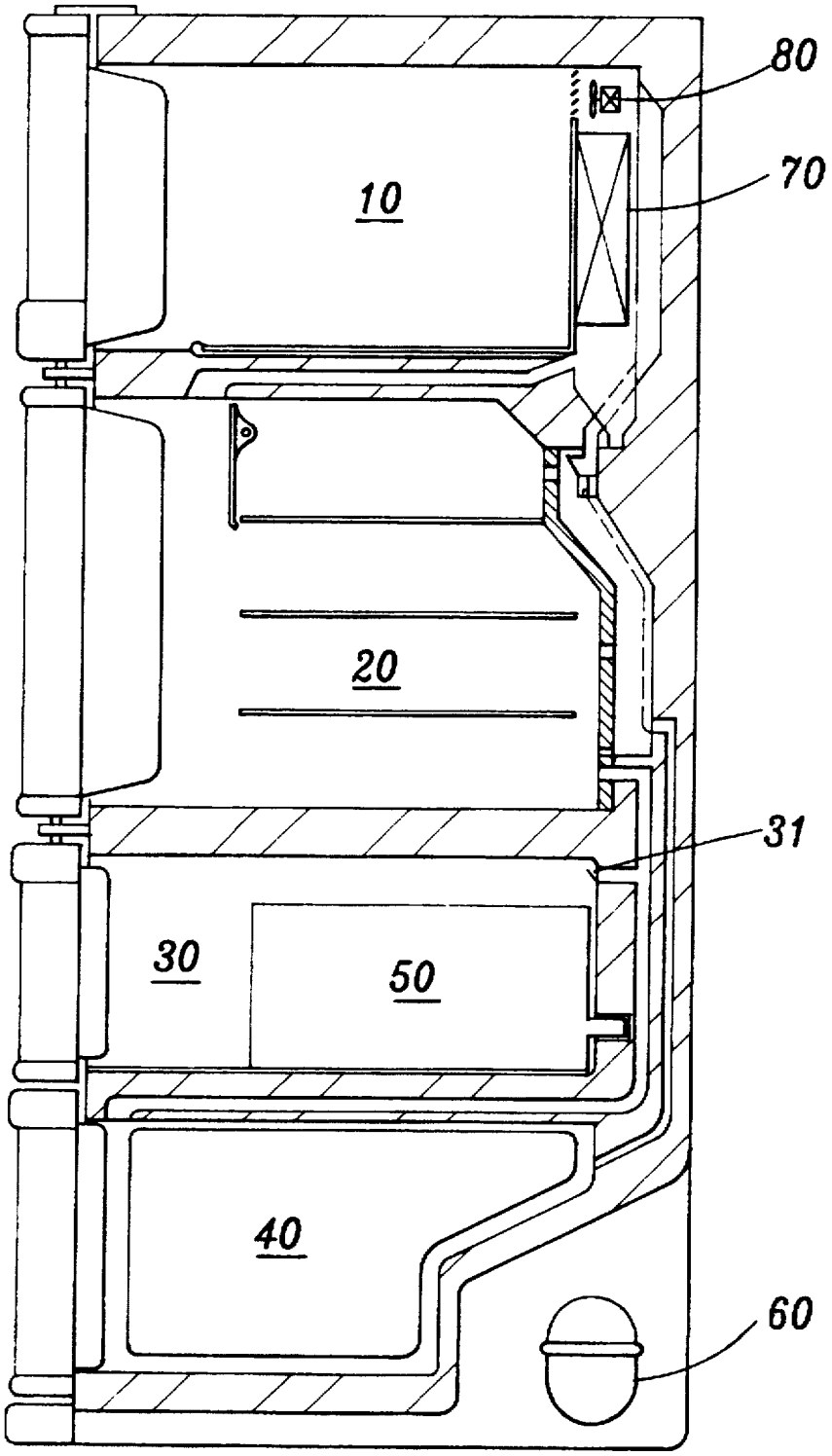
FIG. 1 is a sectional view illustrating a refrigerator with a function of fermenting food according to the first preferred embodiment of the present invention.

Referring to FIG. 1, the refrigerator with a function of fermenting food normally includes a freezing compartment 10 for either producing ice or preserving food below 0° C., a refrigerating compartment 20 for preserving food at about 0° C., and a fermentation/storage compartment 30 for receiving a fermentation container 50, and optionally includes an additional compartment 40 for freshly preserving food such as vegetables, fruits or the like.

In FIG. 1, the reference characters 60 and 70 respectively denote a compressor and a heat exchanger, 80 denotes a blower fan for forcibly blowing cool air to each compartment, 31 denotes a damper for blocking cool air from entering the fermentation/storage compartment 30 or permitting such cool air flow.

Figure 2:
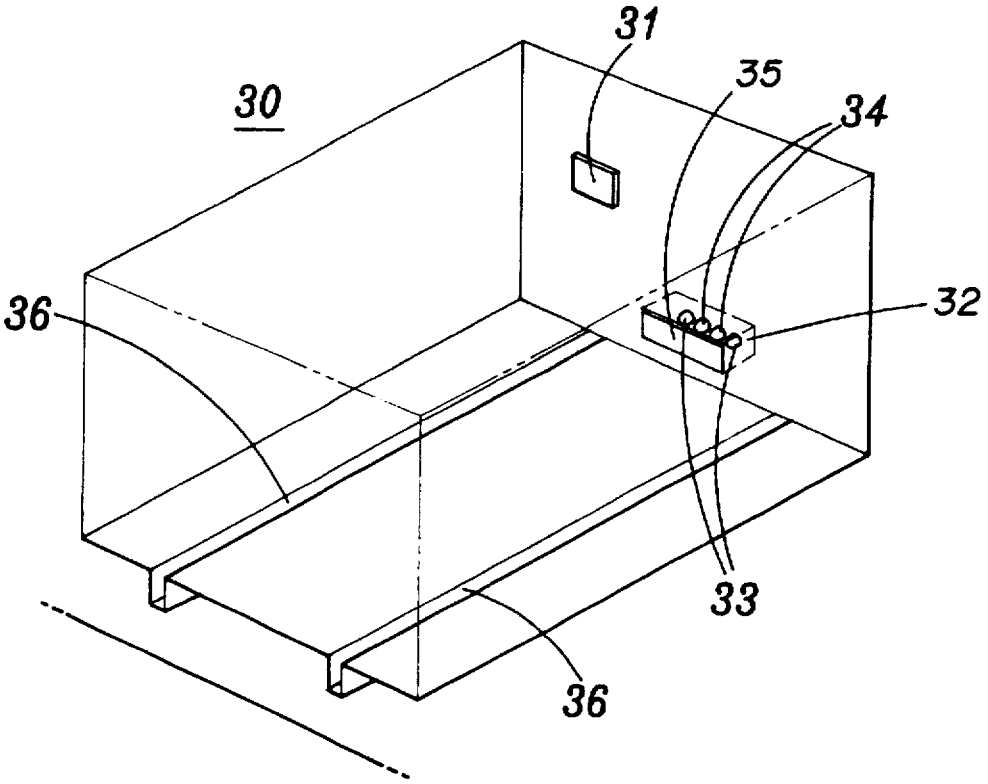
FIG. 2 is an enlarged perspective view illustrating a fermentation/storage compartment of FIG. 1.

FIG. 2 is an enlarged view illustrating a fermentation/storage compartment shown in FIG. 1.

Referring to FIG. 2, the damper 31 is arranged in the upper portion of the rear wall of the fermentation/storage compartment 30. The mounting location of the damper 31 may be properly changed in so far as the operation of the present invention is not hindered.

A recess portion 32 is horizontally formed in the lower portion of the rear wall of the fermentation compartment 30. Two pairs of terminals 33 and 34, which are respectively coupled to a power supply and temperature signal receiving portion (not shown), are disposed in the recess portion 32.

Here, the pair of terminals 33 for power supply may be preferably disposed at the outside of the pair of terminals 34 for temperature signal, thereby reducing electric wave interference between the terminals 33 and 34.

A cover 35 for prohibiting the humidity in the fermentation/storage compartment 30 from entering into the recess portion 32, is pivotally mounted in the opening of the recess portion 32, so that a short circuit of the terminals 33 or current leakage may be prevented.

A pair of grooves 36 for guiding the fermentation container 50 are provided in the bottom wall of the fermentation/storage compartment 30.

Figure 3:
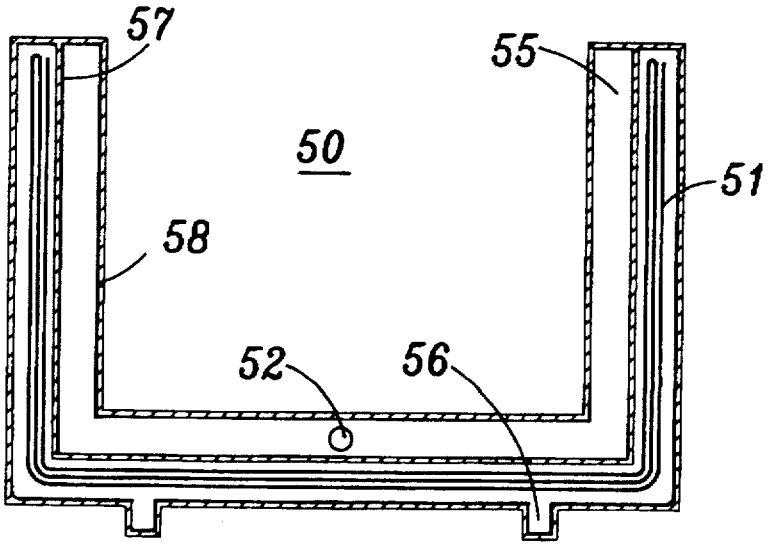
FIG. 3 is an enlarged sectional view illustrating a fermentation container of FIG. 1.

FIG. 3 is an enlarged sectional view illustrating a fermentation container in FIG. 1.

Referring to FIG. 3, a heater 51 is disposed inside of the wall of the fermentation container 50 in a slanting position to the outer wall of the fermentation container 50, and a partition panel 57 for isolating the inner panel 58 of the fermentation container 50 from the heater 51 is provided inside of the wall of the fermentation container 50. Accordingly, a hollow space 55 which is defined by the inner panel 58 and the partition panel 57 is formed in the inside portion of the wall of the fermentation container 50. This hollow space 55 evenly transmits the heat radiated from the heater 51 over the inner wall 58 of the fermentation container 50, thereby causing Kimchi to be evenly fermented.

A temperature sensing element 52 for sensing the temperature of the fermentation container 50, for example, a thermistor is provided in the hollow space 55.

A pair of legs 56 sliding in the guiding grooves 36 are provided on the bottom wall of the fermentation container 50. Not shown, terminals electrically coupled to the heater 51 and temperature sensing element 52, which are to be connected to the terminals 33 and 34 are projected from the outer wall of the fermentation container 50.

FIGS. 4(A) and (B) are views for illustrating connecting and connected members before and after connection according to the first preferred embodiment of the present invention, respectively.

Referring to FIGS. 4(A) and (B), the terminals 33 projected within the recess portion 32 take the shape of pins and the terminals 53 provided in the fermentation container 50 have holes **53*a* in which the pin shaped terminals 33** are respectively inserted by the action of connecting.

On the other hand, the cover 35 is pivotally secured to a side wall of the recess portion 32 to be closed in the normal state (in the state of disconnection) and to be opened upon the application of pushing force (in the state of connection).

In the configuration described above, if the user aligns the sliding legs 56 to the guiding grooves 36 and pushes the container 50 forward when Kimchi is contained in the fermentation container 50, the terminals 53 push away the cover 35 and becomes connected to the terminals 33.

Figure 5:
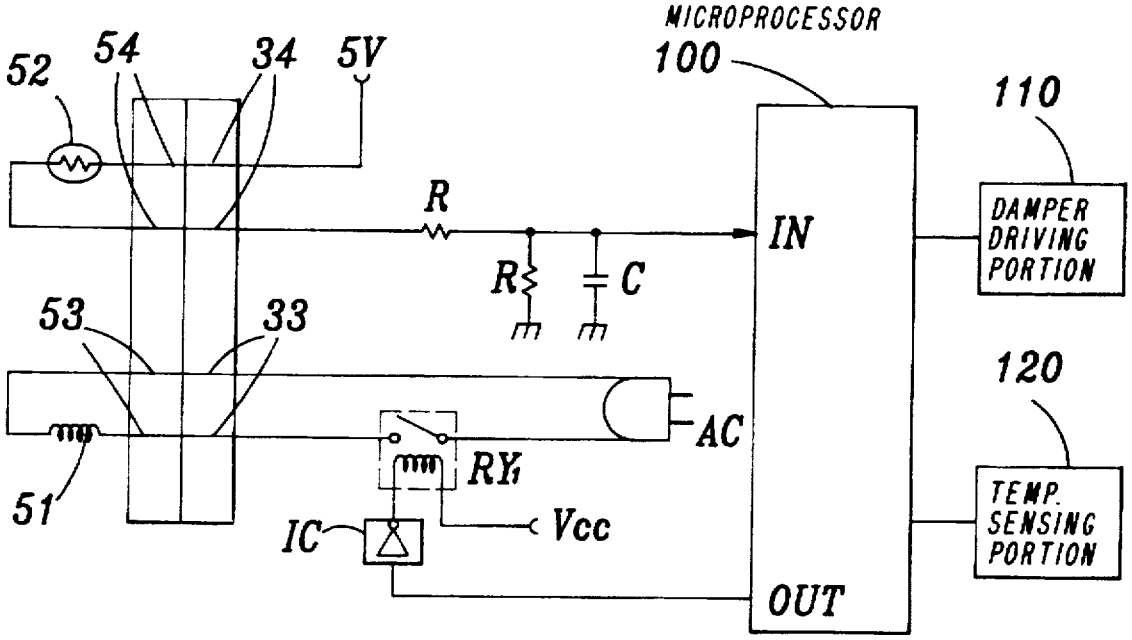
FIG. 5 is a control circuit diagram for a refrigerator with a function of fermenting food according to the present invention.

FIG. 5 is a control circuit diagram for a refrigerator with a function of fermenting food according to the present invention.

Referring to FIG. 5, the control circuit includes (i) a microprocessor 100 for treating key input signals and outputting a control signal according to a control program, (ii) an electric relay RY1 for connecting the heater 51 to the power supply or disconnecting the heater 51 from the power supply according to the control of the microprocessor 100, (iii) the heater 51, (iv) the temperature sensing element 52 for sensing the temperature of the fermentation container 50 and transmitting the temperature signal to the microprocessor 100, (v) a temperature sensing portion 120 for sensing the temperature of the fermentation/storage compartment 30, (vi) and a damper driving portion 110 for driving the damper 31 according to the control signal from the microprocessor 100. The reference character IC denotes an invertor circuit for logically inverting the control signal from the microprocessor 100.

Hereinafter, the operation of the control circuit of the present invention will be described in detail with reference to FIGS. 6(A) and (B) which are flow charts illustrating a control method for a refrigerator according to the present invention.

Figure 6:
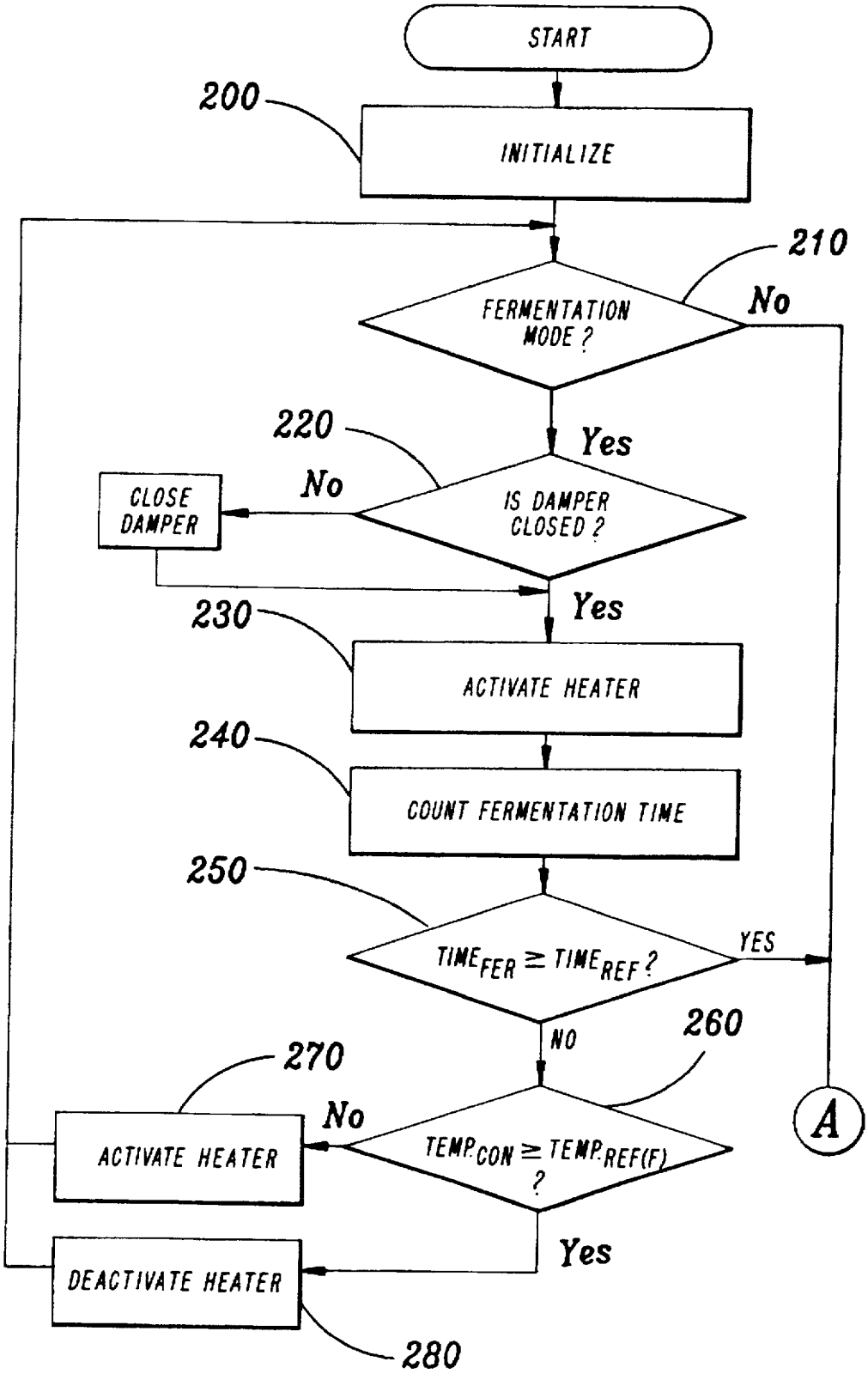
FIGS. 6(A) and (B) are flow charts illustrating a control method for a refrigerator with a function of fermenting food according to the present invention.
Figure 6:
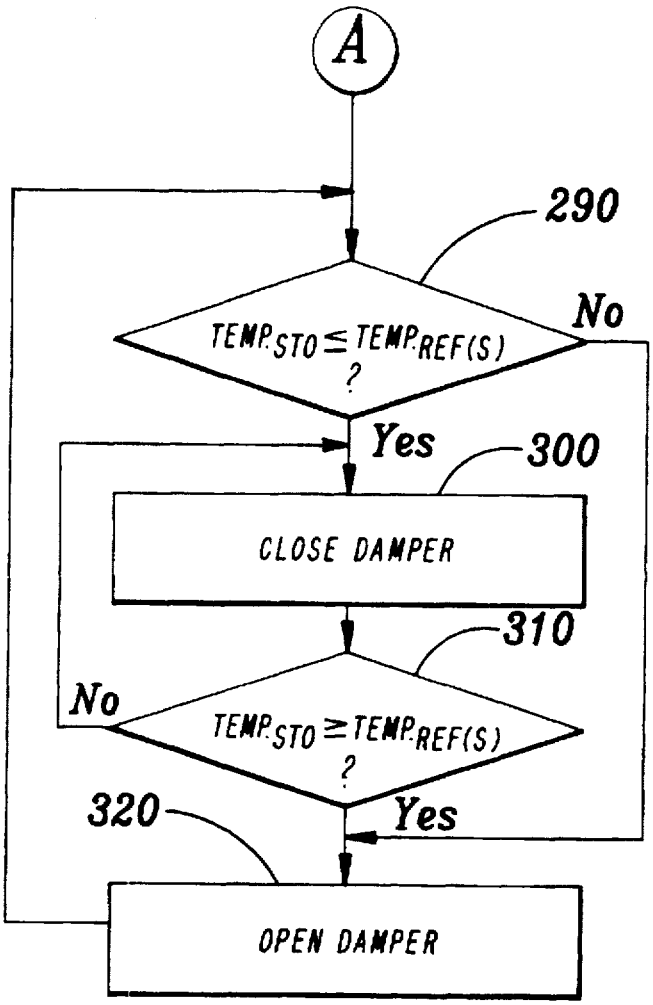

Referring to FIGS. 6(A) and (B), if the user aligns the sliding legs 56 of the fermentation container 50 within the guiding grooves 36 of the fermentation/storage compartment 30 and pushes the fermentation container 50 forward when the refrigerator is performing normal operations, the terminals 53 push aside the cover 35 of the recess portion 32 and become connected with the terminals 33 electrically coupled to the power supply and microprocessor 100.

In this state, the microprocessor 100 determines whether or not a fermentation function is selected in step 210. If so, then in step 220, the microprocessor 100 determines whether or not the damper 31 is closed. If not, i.e., if the damper 31 is opened in step 220, the microprocessor 100 closes the damper 31 by outputting a control signal to the damper driving portion 110. If the damper 31 is closed in step 220, the program proceeds to step 230, in which the heater 51 is turned on. That is, the microprocessor 100 activates the relay RY1 via the invertor circuit IC, thereby supplying A.C. power to the heater 51. Once the fermentation container 50 begins to be heated by performing the step 230, the program proceeds to step 240, in which the fermentation time is counted.

In step 250, the microprocessor 100 determines whether or not the fermentation work is completed by comparing the counted fermentation time with a reference time for fermentation completion.

If the counted fermentation time does not exceed the reference time in step 250, the program proceeds to step 260, in which the microprocessor 100 compares the temperature of the fermentation container 50 with a reference fermentation temperature. If the temperature of the fermentation container 50 is greater than the reference fermentation temperature in step 260, the program proceeds to step 280, in which the heater 51 is turned off. If the temperature of the fermentation container 50 is not greater than the reference fermentation temperature in step 260, the program proceeds to step 270, in which the heater 51 is turned on.

After the reference fermentation work is completed by repeatedly performing the foregoing steps 210 through 280, the storage function is automatically performed through step 290 and the following steps.

In step 290, the microprocessor 100 receives the temperature of the fermentation/storage compartment 30 from the temperature sensing portion 120, and compares it with a reference storage temperature.

If the temperature of the fermentation/storage compartment 30 is less than the reference storage temperature in step 290, the program proceeds to step 300, in which the microprocessor 100 controls closes the damper 31 by controlling the damper driving portion 110, thereby prohibiting cool air from entering into the fermentation/storage compartment 30.

If the temperature of the fermentation/storage compartment 30 is greater than the reference storage temperature in step 300, the program proceeds to step 320, in which microprocessor 100 opens the damper 31 by controlling the damper driving portion 110. The fermentation/storage compartment 30 is maintained at the reference storage temperature by repeatedly performing the foregoing steps 290 through 320, thereby continuously performing the storage function.

If the fermentation function is not selected in step 210, the program directly proceeds to step 290 and the following steps in order to directly perform the storage function as described above, which means that the fermentation/storage compartment 30 is convertible to the normal refrigerating compartment.

Figure 7A:
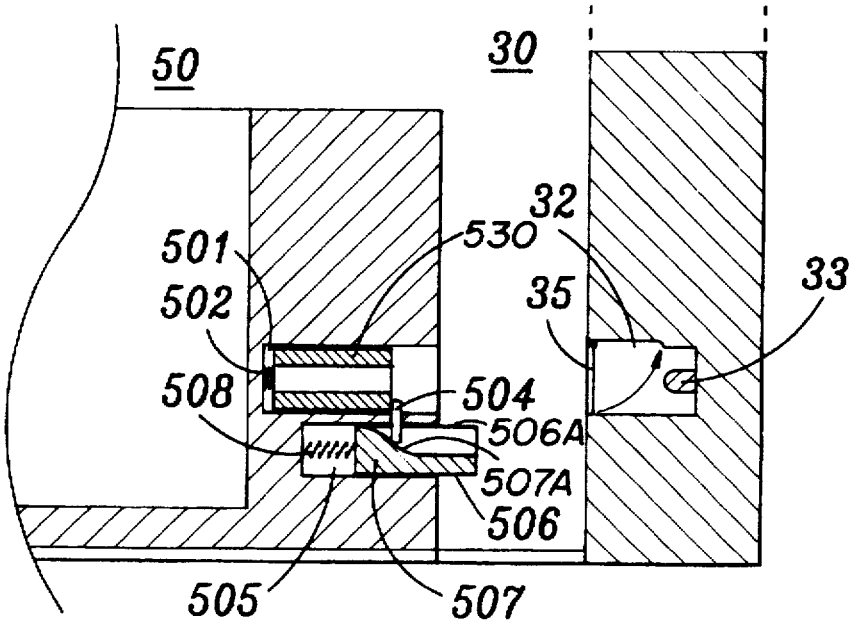
FIGS. 7(A) and (B) are views for illustrating connecting members, respectively, before and after connection according to the second preferred embodiment of the present invention; and, FIGS. 8(A) and (B) are views for illustrating connecting members, respectively, before and after connection according to the third preferred embodiment of the present invention, respectively.

FIGS. 7(A) and (B) are views for illustrating connecting and connected members before and after connection according to a second preferred embodiment of the present invention, respectively.

Referring to FIG. 7(A), the fermentation container 50 has terminals 530 which are retractable into the wall of the fermentation container 50 when they are disconnected from the terminals 33.

More in detail, the fermentation container 50 has a terminal receiving recess 501 horizontally formed in the wall thereof, and the terminals 530 and a resilient member 502, for example, a coil spring are held in the terminal receiving recess 501. Furthermore, a recess 505 is horizontally formed below the terminal receiving recess 501. A hollow tubular member 506 and a resilient member 508, for example, a coil spring are held in the recess 505. The tubular member 506 has a groove 506A which is horizontally formed in the top wall thereof. A guiding member 507 in the form of a sliding bed having a cam face 507A is diagonally disposed in the tubular member 506.

A through hole is formed in the wall interposed between the terminal receiving recess 501 and the recess 505 for communicating with the opening groove, and a stopper pin 504 is disposed in the through hole. The stopper pin 504 is supported on the cam face 507A of the guiding member 507 to be moved upward and downward thereby according to the forward and backward movement of the tubular member 506. When the terminals 530 are held by the stopper pin 504 retracted state within the terminal receiving portion 501, that is, when the terminals 530 of the fermentation container 50 are disconnected from the terminals 33 of the fermentation/storage compartment 30, the tubular member 506 is projected beyond the outer wall of the fermentation container 50.

Figure 7B:
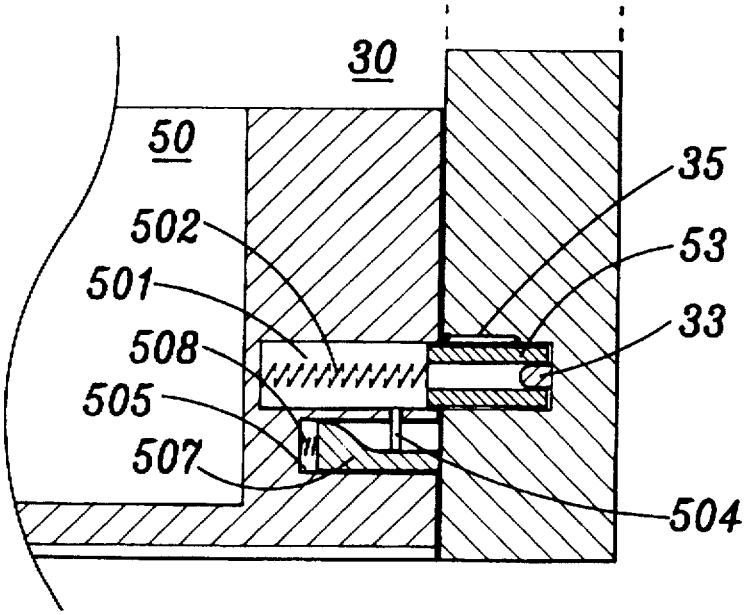

If the user aligns the sliding legs 56 of the fermentation container 50 with the guiding grooves 36 and pushes the fermentation container 50, the fermentation container 50 is bumped against the rear wall of the fermentation/storage compartment 30, thereby causing the tubular member 506 to be retracted into the recess 505. When the tubular member 506 is retracted into the recess 505, the stopper pin 504 moves downward, thereby causing the terminals 530 to be unchecked. The terminals 530 move, then, forward by the elastic force of the resilient member 502, so that they are forcibly connected to the terminals 33 as shown in FIG. 7(B).

On the other hand, the user may disconnect the terminals 530 of the fermentation container 50 from the terminals 33 of the fermentation/storage compartment 30 by pulling the fermentation container 50. Next, the user should simultaneously push both the terminals 530 and the tubular member 506 by hand. Then, if the user releases the force applied to the tubular member 506, the guiding member 507 moves forward by the elastic force of the resilient member 508, thereby causing the stopper pin 504 to move upward. Therefore, the stopper pin prohibits the terminals 530 from projecting out of the terminal receiving recess 501, thereby retaining the terminals 530 within the terminal receiving recess 501.

Figure 8A:
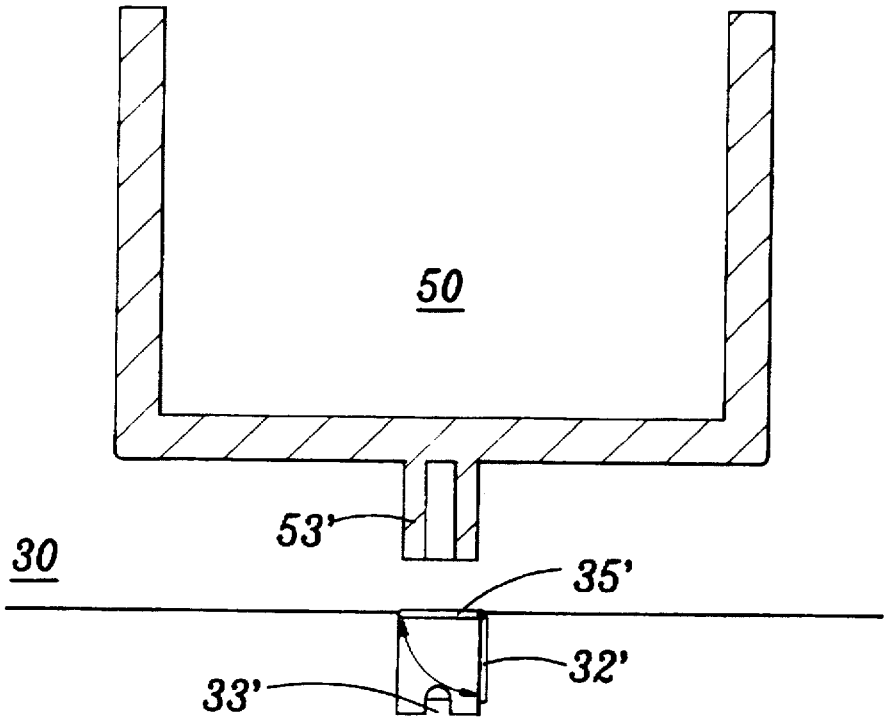
Figure 8B:
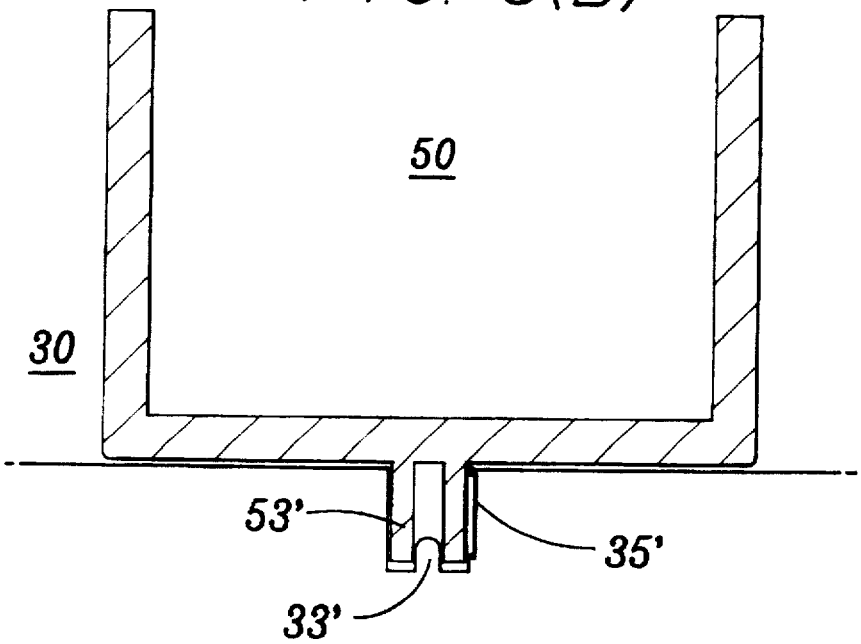

FIGS. 8(A) and (B) are views for illustrating connecting and connected members before and after connection according to the third preferred embodiment of the present invention, respectively.

Referring to FIGS. 8(A) and (B), terminals 53' project downwardly from the bottom wall of the fermentation container 50, and a recess 32' is vertically formed in the bottom wall of the fermentation/storage compartment 30. Terminals 33' project downwardly from the bottom wall of the recess 32'. A cover 35' is provided at the opening of the recess 32'. When the terminals 53 of the fermentation container 50 are disconnected from the terminals 33 of the fermentation/storage compartment 30, the recess 32' is closed by the cover 35'.

In the embodiment described above, when the user vertically aligns the terminals 53' of the fermentation container 50 with the cover 35' and then releases the container, the cover 35' is pushed aside by the weight of the fermentation container 50, thereby causing the terminals 53' to be connected to the terminals 33'.

We claim:

1. A refrigerator adapted for fermenting food and storing fermented food, comprising:

a food fermentation/storage compartment;

a fermentation container for containing food to be fermented and being insertable and removable relative to said compartment, said container including a wall structure forming a floor and a pair of upright side walls, said wall structure including an inside panel extending along said floor and side walls, an outside panel extending along said floor and side walls, and a partition panel extending completely between said inner and outer panels along said floor and side walls in spaced relationship to said inside panel to form a space therebetween;

a heater disposed within said space and extending along said floor and side walls for heating said containers and food disposed therein;

a first electrical connector disposed on said fermentation container and being electrically coupled to said heater; and a second electrical connector disposed in a wall of said compartment and coupled to an electrical power source, said first and second electrical connectors being automatically interconnected in response to insertion of said container into said compartment.

2. The refrigerator according to claim 1, wherein said second electrical connector is recessed within said wall of said compartment.

3. The refrigerator according to claim 1 further including a temperature sensor disposed in said hollow space for sensing a temperature of said container, said temperature sensor being electrically connected to said first electrical connector.

4. The refrigerator according to claim 1, wherein said container and said compartment form a tongue and groove arrangement for guiding said container during sliding movement thereof into and from said compartment.

5. The refrigerator according to claim 4, wherein said tongue and groove arrangement comprises legs projecting from a bottom wall of said container, and grooves formed in a bottom wall of said compartment.

6. A refrigerator adapted for fermenting food and storing fermented food, comprising:

a food fermentation/storage compartment;

a fermentation container for containing food to be fermented and being insertable and removable relative to said compartment, said container including a wall structure;

a heater disposed within said wall structure for heating said container and food therein; a first electrical connector disposed on said fermentation container and being electrically coupled to said heater; and a second electrical connector disposed in a wall of said compartment and coupled to an electrical power source, said first and second electrical connectors being automatically interconnected in response to insertion of said container into said compartment;

said wall structure of said container comprising an inside panel, an outside panel, and a partition panel disposed therebetween for forming a hollow space with said inside panel, said heater disposed between said outside panel and said partition panel, and further including a temperature sensor disposed in said hollow space for sensing a temperature of said container, said temperature sensor being electrically connected to said first electrical connector.

7. The refrigerator according to claim 6, wherein said second electrical connector is recessed within said wall of said compartment.

8. The refrigerator according to claim 7, wherein said wall structure of said compartment comprises a vertical wall, said second electrical connector being horizontally recessed within said vertical wall.

9. The refrigerator according to claim 8, including an openable cover for closing a recess in said vertical wall in which said second electrical connector is disposed, said cover being automatically pushed open in response to insertion of said first electrical connector into said second electrical connector.

10. The refrigerator according to claim 7, wherein said first electrical connector is movable between an extended state in which it extends from a wall of said container to a retracted state in which it is retracted within said wall of said container.

11. The refrigerator according to claim 10, including a spring biasing said first electrical connector to its extended state.

12. The refrigerator according to claim 11, including a releasable stop for holding said first electrical connector in its retracted state, said stop being automatically released in response to insertion of said first electrical connector into said second electrical connector.

13. The refrigerator according to claim 7, wherein said wall of said compartment comprises a horizontal bottom wall thereof, said second electrical connector being recessed within said bottom wall, said first electrical connector projecting downwardly from said bottom wall of said container.

14. The refrigerator according to claim 13 further including an openable cover for closing a recess in said bottom wall in which said second electrical connector is disposed, said cover being automatically pushed open in response to insertion of said first electrical connector into said second electrical connector.

* * * * *